US005347686A

United States Patent [19]

Tyler et al.

[11] Patent Number: 5,347,686

[45] Date of Patent: Sep. 20, 1994

[54] CONVERTIBLE HINGE PREPARATION ASSEMBLY AND METHOD

[75] Inventors: Larry Tyler, Jackson, Tenn.; Jack Burbidge, Downer's Grove, Ill.; Steve Gilliam, Lexington; Gary Hampton, Bruceton, both of Tenn.; Jim Olson, Milan; Ron Simmons, Trezevant, both of Tenn.

[73] Assignee: Ceco Door Products, Milan, Tenn.

[21] Appl. No.: 167,130

[22] Filed: Dec. 16, 1993

Related U.S. Application Data

[62] Division of Ser. No. 929,430, Aug. 14, 1992, abandoned.

[51] Int. Cl.[5] ..... E05D 7/04

[52] U.S. Cl. ..... 16/247; 16/382

[58] Field of Search ..... 16/247, 240, 241, 246, 16/382, 384, DIG. 43, DIG. 39, DIG. 29; 49/504

[56] References Cited

U.S. PATENT DOCUMENTS

| | | | |
|---|---|---|---|
| 1,323,757 | 12/1919 | Gogay | 16/382 |
| 2,940,115 | 6/1960 | Hansen | 16/246 |
| 3,263,368 | 8/1966 | Hildum | 16/247 |
| 4,034,514 | 7/1977 | Cecil | 49/504 |
| 4,087,942 | 5/1978 | Herrmann | 16/382 |
| 4,547,930 | 10/1985 | King et al. | 16/382 |
| 4,553,286 | 11/1985 | Schwarz, II | 16/382 |
| 4,635,399 | 1/1987 | Gehrke et al. | 49/504 |
| 4,639,971 | 2/1987 | Kurtz | 16/247 |
| 4,825,509 | 5/1989 | Mitchell et al. | 16/382 |
| 5,072,488 | 12/1991 | Winyard | 16/241 |

*Primary Examiner*—P. Austin Bradley
*Assistant Examiner*—Chuck Y. Mah
*Attorney, Agent, or Firm*—Foley & Lardner

[57] ABSTRACT

A convertible hinge preparation assembly is mounted in hinge cut-outs of a steel door frame or door. The convertible hinge preparation assembly is capable of mounting either regular weight hinges or heavy weight hinges. A plurality of pips are provided for positioning a regular weight hinge. The pips are removed by grinding or drilling when it is desired to mount a heavy weight hinge. In standard weight hinge applications, selective pips, or portions thereof, may also be removed to provide additional adjustment of the installed door and frame assembly to achieve desired operating clearances. The pips are formed by punching the hinge reinforcing member.

4 Claims, 4 Drawing Sheets

CONVERTIBLE HINGE PREPARATION ASSEMBLY AND METHOD

This application is a division of application Ser. No. 07/929,430, filed Aug. 14, 1992, now abandoned.

BACKGROUND OF THE INVENTION

This invention relates generally to hinge preparation assemblies, and particularly to a hinge preparation assembly that can be converted to receive regular or heavy weight hinges.

Hinge cutouts are usually made during the formation of the hinge jamb members of a steel door or steel door frame. A hinge reinforcement member, in the form of a plate or channel, is generally welded across the hinge cutouts and serves to support a hinge leaf. The hinge reinforcement member has threaded holes corresponding to the holes in the hinge leaf.

To avoid the necessity of separately manufacturing and stocking door frames and doors that will accommodate either regular weight or heavy weight hinges, efforts have been made to provide hinge preparation assemblies that permit converting from a regular weight to a heavy weight hinge without changing the depth of the cutouts.

In one such effort, set screws are positioned between a regular weight hinge and the hinge reinforcement member. When it is desired to convert to a heavy weight hinge, the set screws are either removed or screwed into the hinge reinforcement member. U.S. Pat. No. 5,072,488 to Winyard shows such a set screw arrangement.

The problem with the set screw arrangement is that it is expensive and time-consuming to manufacture. Holes for the set screws must be formed in the hinge reinforcement member and threaded. Additionally, blanks for the set screws must be manufactured and threaded.

SUMMARY OF THE INVENTION

An object of the present invention is to provide an improved convertible hinge preparation assembly and method for mounting either regular weight or heavy weight hinges.

Another object of the invention is to provide a convertible hinge preparation assembly and method for quickly converting from a regular weight hinge preparation to a heavy weight hinge preparation.

A further object of the invention is to provide a convertible hinge preparation assembly which is easier to manufacture.

These and other objects and advantages of the present invention are achieved by a convertible hinge preparation assembly for mounting regular weight or heavy weight hinges to a door or frame having a cut-out section comprising: a hinge reinforcing member having a hinge mounting surface, means for attaching the hinge mounting surface to the cut-out section, and a plurality of threaded holes corresponding to holes in the regular and heavy weight hinges; and a plurality of pips located on the hinge mounting surface, the pips being formed by punching the hinge reinforcing member.

When mounting regular weight hinges, the pips function as a spacer to properly position the regular weight hinges. When mounting heavy weight hinges, the pips are either ground off or drilled out.

Other objects and advantages and a fuller understanding of the invention will be had from the following detailed description of a preferred embodiment and the accompanying drawings.

DETAILED DESCRIPTION OF THE PREFERRED EMBODIMENT

Figure 1:
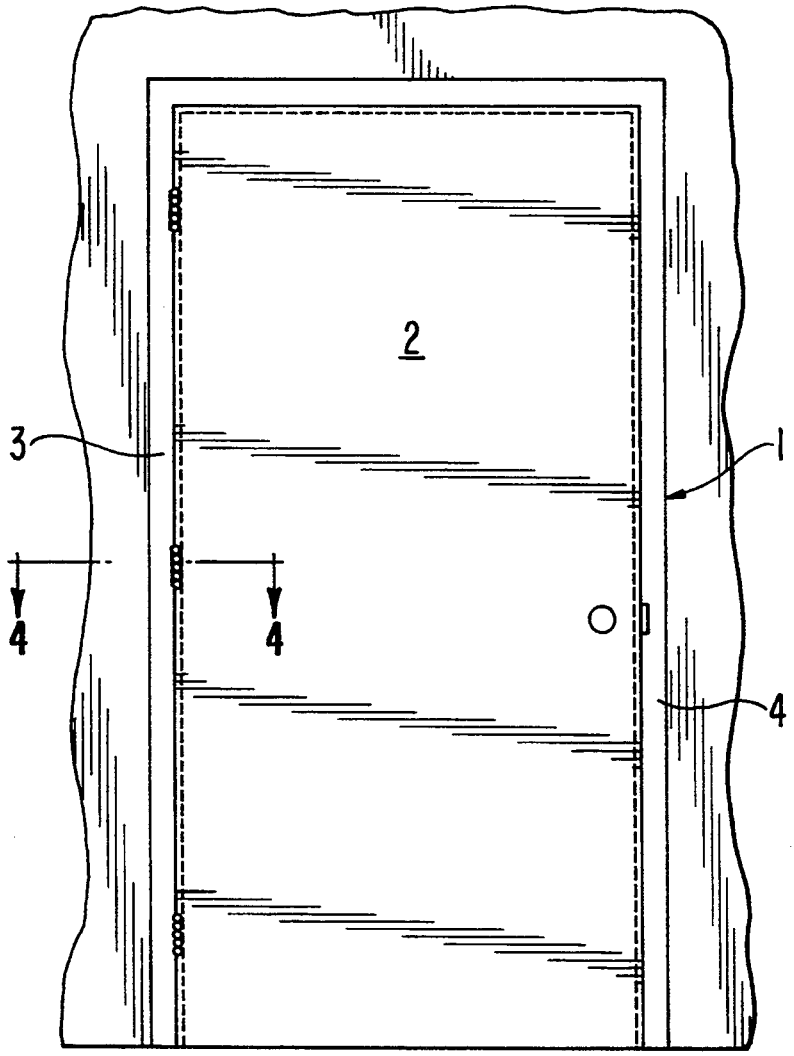
FIG. 1 is an elevational view of a steel door and steel frame made in accordance with the present invention.

Referring to FIG. 1, a steel door frame 1 is shown supporting a door 2. The door frame comprises a hinge jamb 3 and a strike jamb and frame header 4. Hinge cut-outs 5 (FIG. 3) are formed in the hinge jamb 3 and the door 2 at spaced intervals. A convertible hinge preparation assembly 6 serves to mount the door 2 to the door frame 1.

Figure 3:
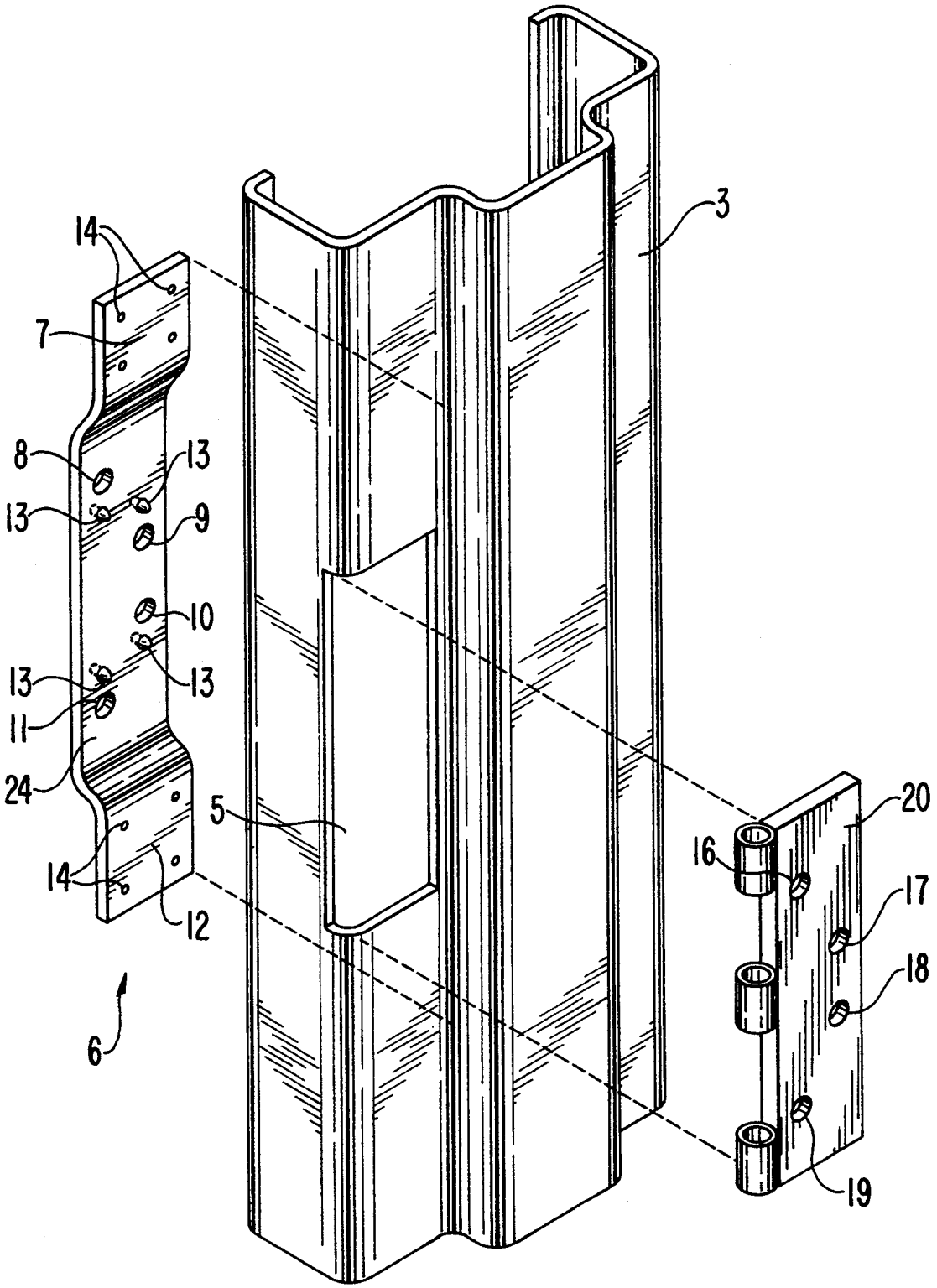
FIG. 3 is an exploded view, in perspective, of a section of the hinge jamb, showing the convertible hinge preparation assembly of the present invention.

As shown in FIG. 3, the convertible hinge preparation assembly 6 comprises a hinge reinforcement member 12 mounted to the inside of the hinge jamb 3 so as to bridge the hinge cut-outs 5. The member 12 is mounted to the hinge jamb 3 by projection welding or other conventional means. For this purpose, weld pips 14 are located on the attaching means 7 which includes planar surfaces located at opposite ends of the hinge mounting surface 24.

Each hinge reinforcement member 12 includes a plurality of spaced-apart threaded holes 8–11. As shown in FIG. 3, holes 8–11 serve to secure the regular weight or heavyweight hinge leaf 20 to the reinforcement member 12. The hinge leaf 20, whether regular or heavy weight, includes four holes 16–19 for mounting. These holes are not threaded.

Hinges 25 are mounted to the hinge reinforcement members 12 by fastening a hinge leaf 20 to the hinge reinforcement member 12 with hinge mounting screws (not shown).

As shown in FIG. 3, the hinge reinforcing member 12 includes a hinge mounting surface 24, means 7 for attaching the hinge mounting surface 24 to the cut-out section 5, and a plurality of threaded holes 8–11 corresponding to holes 16–19 in the regular and heavy weight hinges. A plurality of pips 13 are provided on the hinge mounting surface 24. The pips 13 are formed by punching the hinge reinforcing member 12. The convertible hinge preparation assembly of the present invention is preferably made of steel. The number of pips 13 is conveniently made to be four although other numbers are possible.

The means 7 for attaching the hinge mounting surface 4 to the cut-out section 5 includes planar surfaces located at opposite ends of the hinge mounting surface 24.

The planar surfaces include a plurality of weld pips 14 for projection welding to the door or frame.

Figure 2:
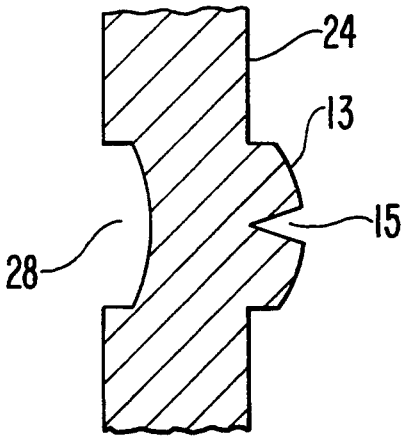
FIG. 2 is an enlarged fragmentary sectional view taken along the line 2—2 of FIG. 6.

As shown in FIG. 2, each pip 13 further includes a crater 15 located on the face of the pip. The pips 13 are preferably about 0.046 to 0.064 inches high and about 0.187 inches in diameter.

Figure 6:
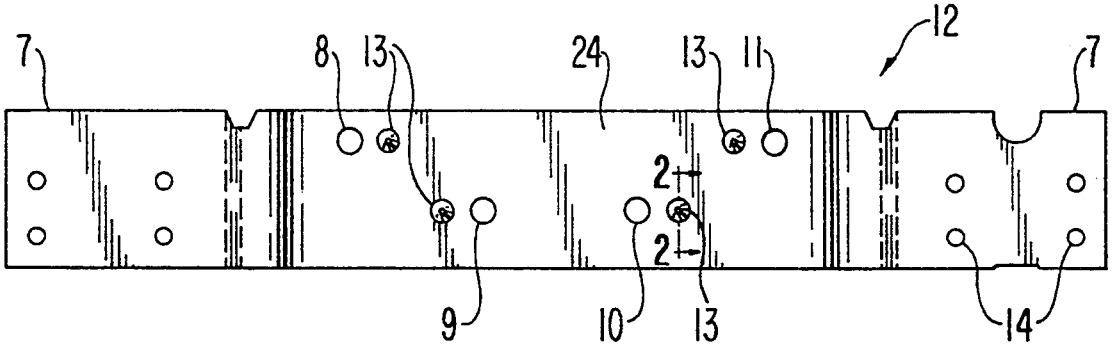
FIG. 6 is a plan view of the hinge reinforcing member.

FIG. 6 shows one possible arrangement of the pips 13 in relation to the threaded holes 8–11 on the hinge mounting surface 24 of the hinge reinforcing member 12. The pips 13 are about 0.046 inches high.

Figure 7:
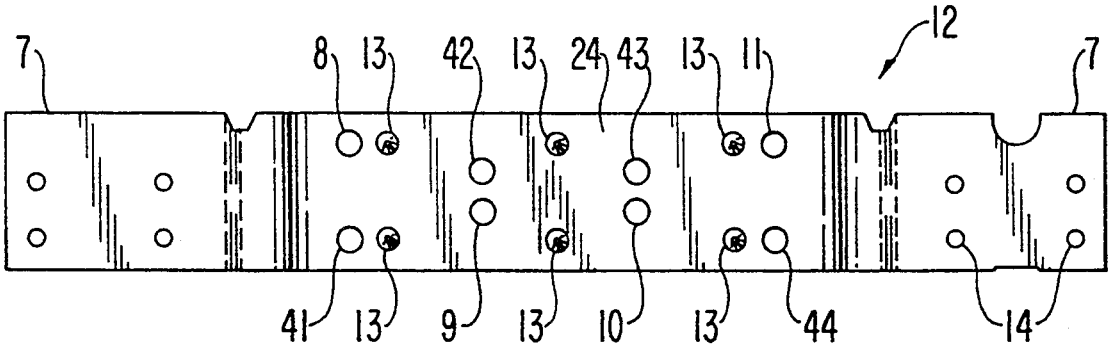
FIG. 7 is a plan view of another arrangement of the hinge reinforcing member.

FIG. 7 shows another possible arrangement of the pips 13 on the hinge mounting surface 24. The arrangement of FIG. 7 is designed for a non-handed door. In addition to threaded holes 8–11, there are provided threaded holes 41–44, for mounting the hinge in the opposite direction. Six pips 13 are provided. The pips 13 in this arrangement have a height of about 0.064 inches.

Figure 4:
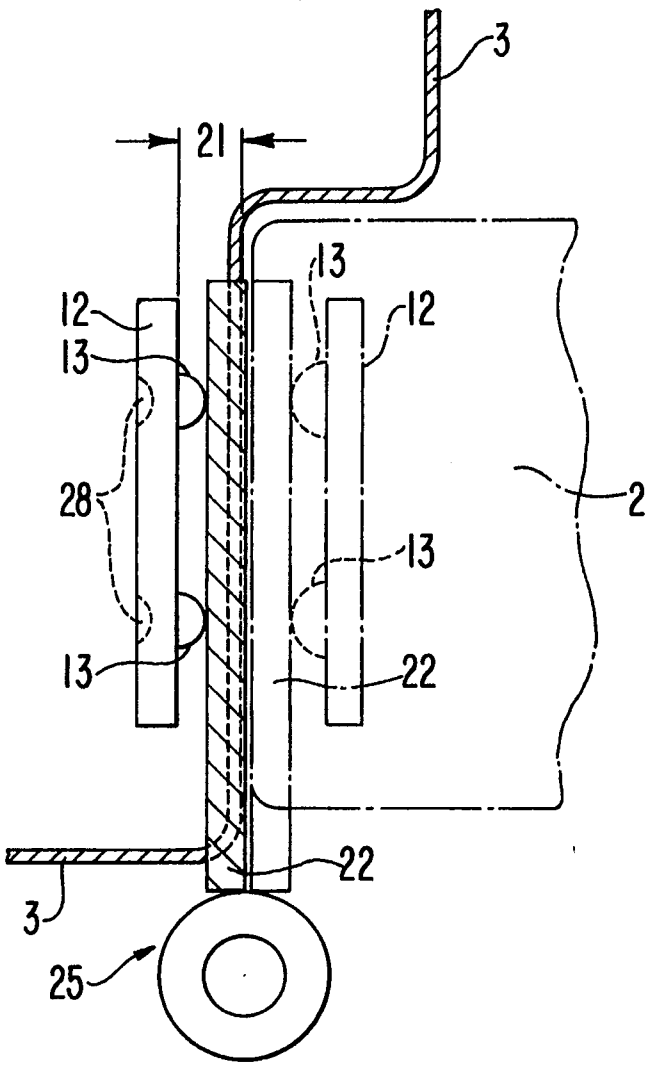
FIG. 4 is a fragmentary, cross-sectional view taken along the line 4—4 of FIG. 1 when regular weight hinges are mounted with the hinge preparation assembly of the present invention.

FIG. 4 shows a fragmentary cross-section of the convertible hinge preparation assembly of the present invention. The hinge reinforcing member 12 is shown mounted in the hinge jamb 3. A similar arrangement exists in the door 2, which is shown by phantom lines in FIGS. 4 and 5.

In FIG. 4, a hinge 25 with regular weight hinge leaves 22 is mounted to a hinge jamb 3 and door 2. The pips 13 function to position the leaves 22 properly in the mortise depth 21.

Figure 5:
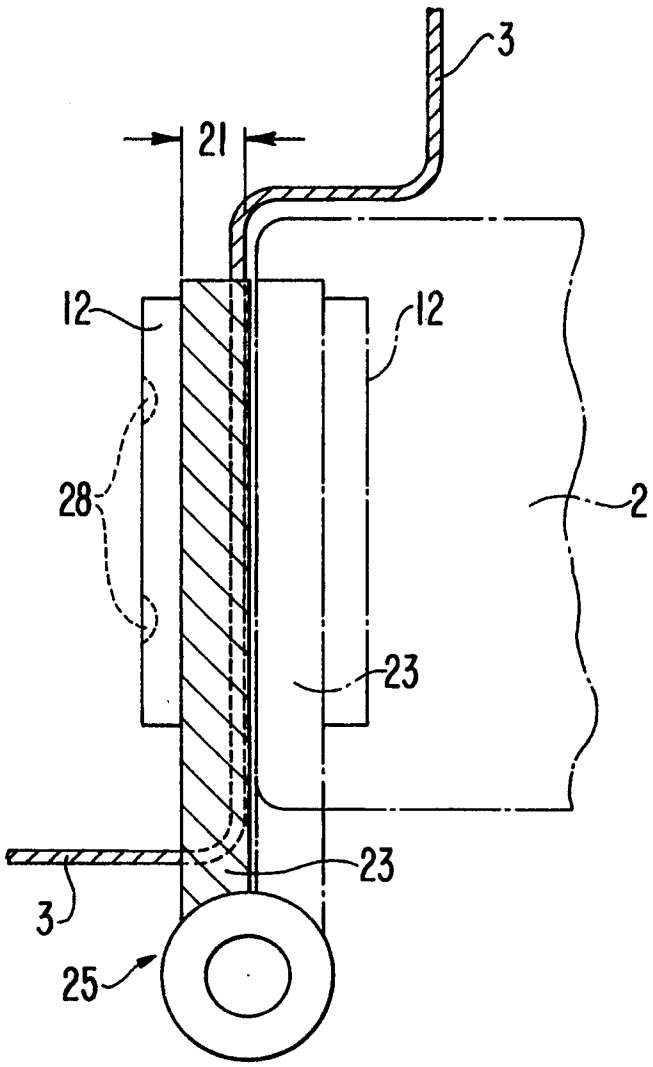
FIG. 5 is a fragmentary, cross-sectional view taken along the line 4—4 of FIG. 1 when heavy weight hinges are mounted with the hinge preparation assembly of the present invention.

If it is desired to use a heavyweight hinge as shown in FIG. 5, the pips 13 are removed by grinding or drilling out the pips. To facilitate drilling out of the pips, a crater 15 is provided on the surface of the pip 13 for insertion of the drill tip. The crater 15 is formed with an embossing die at the same time that the pip 13 is formed by punching the hinge reinforcing member 12. In standard weight hinge applications, selective pips, or portions thereof may be removed to provide for shimming of individual hinge leaves and thereby adjust the operating clearances of the installed door and frame assembly.

In FIG. 5, heavyweight hinge leaves 23 are mounted flush against the hinge mounting surface 24. With the pips 13 removed, the heavy weight hinge leaves 23 fit into the mortise depth 21.

Depending on the characteristics of the particular door and hinge jamb, it may be necessary to grind or file down the mortise depths on both the door and jamb. It is more likely that the mortise depth on the door will need adjustment than that on the jamb.

One particular advantage of the present invention is the ease of manufacture of the hinge reinforcing member 12. The pips 13 are easily punched into the hinge reinforcing member 12 and at the same time the crater 15 is embossed on the surface of the pip 13. The present invention provides a convertible hinge preparation assembly that is easy and economical to manufacture and use.

As an example, the dimensions of a convertible hinge preparation assembly for use with a $4\frac{1}{2}''$ door or frame are as follows: The hinge reinforcing member 12 is approximately $1\frac{1}{4}''$ wide and about 9" long. The assembly is made from 7 gauge hot rolled steel. The hinge mounting surface is about $5\frac{1}{4}''$ long. Each planar surface of the attaching means is about $1\frac{7}{8}''$ long. The pips are about 0.046" high and about 0.187" in diameter. The crater in the pip is about 0.062" in diameter and 0.046" deep.

The present disclosure of the preferred embodiment has been made only by way of example and numerous changes in the details of construction and the combination and arrangement of parts may be resorted to without departing from the spirit and scope of the invention as hereinafter claimed.

What is claimed is:

1. A method of using a convertible hinge preparation assembly, comprising the steps of:

providing a hinge reinforcing member having a plurality of integrally formed pips thereon that are composed of material from said hinge reinforcing member, the pips being provided for positioning hinge leaves; and removing at least a portion of one of the integrally formed pips from said hinge reinforcing member.

2. The method of claim 1, further comprising the step of adjusting a mortise depth by grinding or filing.

3. The method of claim 1, wherein the step of removing includes the step of grinding away at least a portion of one of the integrally formed pips.

4. The method of claim 1, wherein the step of removing includes the step of drilling out at least portion of one of the integrally formed pips.

* * * * *